US005113550A

United States Patent [19]

Siegenthaler

[11] Patent Number: 5,113,550

[45] Date of Patent: May 19, 1992

[54] SLIVER CLAMP AND METHOD FOR RETRIEVING SLIVER CANS FOR FURTHER PROCESSING

[75] Inventor: Marcel Siegenthaler, Effretikon, Switzerland

[73] Assignee: Maschinenfabrik Rieter AG, Winterthur, Switzerland

[21] Appl. No.: 605,823

[22] Filed: Oct. 30, 1990

[30] Foreign Application Priority Data

Nov. 7, 1989 [CH] Switzerland ..... 04012/89

[51] Int. Cl.[5] ..... D01G 23/00; D01H 15/00

[52] U.S. Cl. ..... 19/159 A; 57/263; 57/281; 19/0.25

[58] Field of Search ..... 19/0.25, 144, 149, 150, 19/157, 159 R, 159 A; 57/22, 83, 261, 264, 266, 281, 405, 408, 409, 263; 226/10, 11

[56] References Cited

U.S. PATENT DOCUMENTS

| | | | |
|---|---|---|---|
| 3,246,371 | 4/1966 | Tooka | 19/159 A |
| 4,224,719 | 9/1980 | Bulla | 19/157 |
| 4,653,263 | 3/1987 | Stahlecker et al. | 57/83 X |
| 4,866,814 | 9/1989 | Carbonetto | 19/159 A |
| 4,939,895 | 7/1990 | Raasch et al. | 57/281 X |
| 4,972,669 | 11/1990 | Raasch | 57/281 |
| 4,982,563 | 1/1991 | Stahlecker | 19/0.25 X |

FOREIGN PATENT DOCUMENTS

| | | | |
|---|---|---|---|
| 0069087 | 1/1983 | European Pat. Off. . | |
| 0301330 | 2/1989 | European Pat. Off. . | |
| 0340459 | 11/1989 | European Pat. Off. . | |
| 2646313 | 7/1986 | Fed. Rep. of Germany . | |
| 3616833 | 11/1987 | Fed. Rep. of Germany | 19/159 A |

*Primary Examiner*—Werner H. Schroeder
*Assistant Examiner*—Ismael Izaguirre
*Attorney, Agent, or Firm*—Dority & Manning

[57] ABSTRACT

A catcher device with a clamp is fitted about the outer surface of a fiber sliver can. The can may rotate on its longitudinal axis whereby an end of a fiber sliver is also moved in the direction of the catcher device. Through the rotation of the can, the fiber sliver is laid in the clamp and drawn through it until the desired length of the sliver end is reached. At this moment, the clamp is closed and the sliver end is clamped in the catcher device. The clamp comprises two clamping elements, which are actuated through a cam plate with trigger cams. The control is effected by sensors and a driving motor.

21 Claims, 3 Drawing Sheets

SLIVER CLAMP AND METHOD FOR RETRIEVING SLIVER CANS FOR FURTHER PROCESSING

BACKGROUND OF THE INVENTION

The invention relates to a method and a device for fixing the end of the fiber sliver on fiber sliver cans by means of a clamping device, whereby the end of the fiber sliver on the fiber sliver can hangs down loosely on the outer surface of the can and the can is able to rotate on its longitudinal axis.

With the operation of textile machines, e.g. spinning machines, fiber sliver cans are continually filled and emptied. Thereby, the empty fiber sliver cans are changed for full cans and vice versa. With every delivery of a full fiber can in the working process of the fiber sliver, the end of the fiber sliver must be caught and guided into the textile machine.

German Patent Specification DE 26 46 313 discloses a device by means of which a textile sliver hanging over the rim of a can is fed into a fiber sliver feeding device of a spinning machine. This device comprises a swivel arm with a clamp with which the end of the fiber sliver is held. As, with this device, the swivel arm is fixed rigidly to a can changing device and the can, for its part, is positioned permanently in a manipulator, then the fiber sliver must hang down in a place over the rim of the can which is determined exactly and/or be laid in the swivel arm manually and firmly clamped there. This operation is labor-intensive and prevents the desired automatic progress of the spinning operation.

Another device and a method for fixing a fiber sliver and which hangs on the outside of containers is disclosed in the European Patent Specification No. 69 087 B1. Here, the containers, fiber sliver cans, for instance, are pushed along a transport route between various textile machines. In addition to the transport route, a catcher device is arranged for the sliver ends, which can be slid along a partial area of the transport route. The catcher device has sensors, by means of which the presence of a sliver in the area of the catcher device may be determined. For fixing the sliver end, firstly, a can is brought into the vicinity of the catcher device and then the can is rotated on its longitudinal axis until a sensor of the catcher device, arranged against the outer surface of the container detects the sliver. Subsequently, the catcher device must be brought up to the outer surface approximately at right angles to the container. In addition, the container and the catcher device must be pushed in the vertical direction relatively to each other, in order to bring the end of the sliver into the correct catching position. The detection of the sliver by means of the sensor is already beset with difficulties. The sliver is often hanging in a position which is inclined, twisted, kinked or irregular in some other way on the outer surface of the container. Or, longitudinal seams or other disturbing elements are present on the container surface, which the sensor erroneously detects as textile slivers. In the latter case, the sliver end cannot be fixed and the can or the entire process is stopped. With inclined or kinked slivers the sensor can, indeed, detect a sliver, but it loses it again through the vertical process, or the clamping elements do not close on the sliver, as they are incorrectly conveyed. Through this, disturbances appear and the automatic operation of the process must be frequently interrupted. It is also possible, that the end of a sliver, which is situated too far from the container outer surface is entangled on the outside of the catcher device or of the clamping elements and cannot be caught at all. Furthermore, the positioning of the catcher device in several steps wastes time and requires more drives and control elements, whereby the susceptibility to disturbances of the installation is likewise increased. This known method is not able to satisfy the requirements of an automatic operation sequence.

SUMMARY OF THE INVENTION

It is the object of the present invention to provide a method and a device with which the fiber sliver end is automatically and reliably fixed, and can be automatically caught by a catcher device without additional position movements. The method and the device of the invention make manual interventions superfluous, make the automation of the can change operation possible and reduce the quota of errors with the fixing of the sliver.

The substantial advantages of the invention can be seen in that the fiber sliver can hang down in any desired place and in any desired manner. It can be straight, twisted or with a spacing to the can outer surface. The method according to the invention and the catcher device according to the invention make possible fully automatic and reliable catching or fixing of the end of the fiber sliver in every case. The catcher device is fitted in the upper part of the outer surface of the can, whereby it is situated in the vertical height of the can, which corresponds to the length of the sliver which is hanging down. Subsequently, the can is rotated on its longitudinal axis until the fiber sliver is laid in the catcher device through the rotating movement. Through additional rotation of the can, the fiber sliver is drawn through the sliver clamp until the end of the sliver has the desired spacing from the catcher device. At this moment, the sliver clamp is closed and the rotation of the can is stopped. The fiber sliver is firmly clamped in the catcher device in such a way that it has the desired position for the delivery to the fiber sliver feeding device of the textile machine.

The relative movements of the can outer surface or the end of the fiber sliver which is hanging down to the catcher device can be influenced in that the catcher device, in addition to the rotary movement of the can, is also movable on a circular path. Through this movement, the catching of the fiber sliver is accelerated or delayed depending on whether the catcher device is moved with or against the direction of rotation of the can. With these variants of the invention also, the end of the sliver is drawn through the sliver clamp until it has reached the desired position as a result of the relative movement. With each of these variants of the invention, the sliver end is found and fixed in the desired position and made ready for the delivery to the textile machine. As the clamping element is directed against the rotation of the outer surface of the can or of the fiber sliver and the clamping element lies more or less on the surface, the fiber sliver is laid without sensors or further auxiliary means in the clamping element of the catcher device. An additional displacement of the catcher device is unnecessary, as the end of the sliver is drawn into the correct position to the catcher device through the rotary movement. Through this movement, the fixing operation for the end of the sliver is simplified and can thus be performed more rapidly. The disturbances which occur with the known devices are almost completely avoided and the method according to the invention leads to higher operating reliability and therewith to improved profitability.

The device of the invention serves at the same time as a delivery device, in that the catcher device, after fixing the fiber sliver, is moved into a delivery position in which the fiber sliver can be delivered to the following machine. This delivery position is then, independent of the position of the can itself, as the sliver end is fixed in the catcher device. The method and the catcher device according to the invention thereby make full automation of the can changing possible. When filling the cans, the fiber sliver can be separated at the end of the filling operation and allowed to fall, whereby it can then hang down in any desired position over the rim of the can. Additional manual operations are then unnecessary, as the end of the sliver is found and fixed in any case.

BRIEF DESCRIPTION OF THE DRAWINGS

In the following, the invention, as well as further advantages and details of embodiments, are explained more closely with reference to the attached drawings, wherein.

DESCRIPTION OF THE PREFERRED EMBODIMENTS

Figure 1:
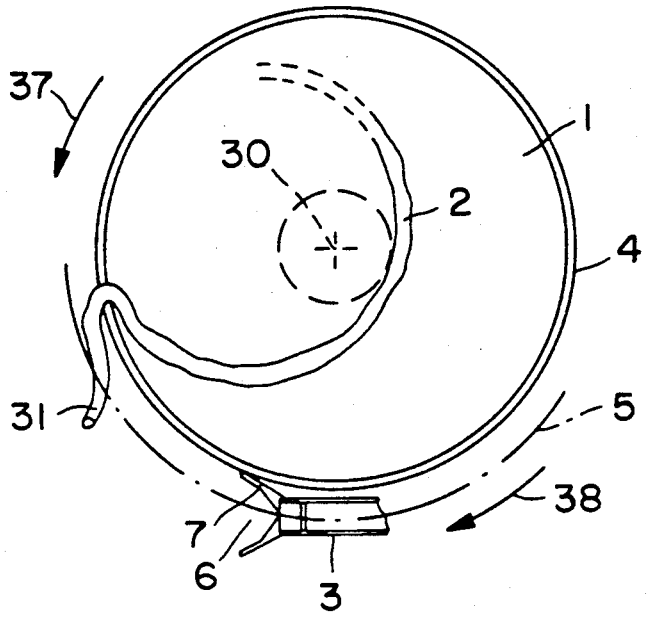
FIGS. 1 is a top view of a can with a fiber sliver and a catcher device represented schematically.

The can represented in FIG. 1 is filled with a fiber sliver and is situated on a changing device which is now shown, e.g. a transport vehicle. The can 1 revolves on its vertical axis 30. In addition, there is a platform arranged on this transport vehicle, likewise not shown, which revolves and acts as a carrier for the can 1. The fiber sliver 2 is laid on loops in the can in the conventional manner, whereby the end 31 hangs down over the rim of the can 1. A catcher device 3 is arranged in the space around the outer surface 4, and is connected with a manipulator, not shown. This manipulator makes possible the displacement of the catcher device 3 along the circular path 5 and of movement in the vertical and horizontal directions. A clamp 6 is arranged on the front end of the catcher device 3, by means of which the fiber sliver 2 is fixed and retained. In the receiving position for the fiber sliver 2, a part of the clamp 6 lies in contact with the surface 4 of the can 1, whereby a spacing is available which is necessary for the movement sequence.

Figure 2:
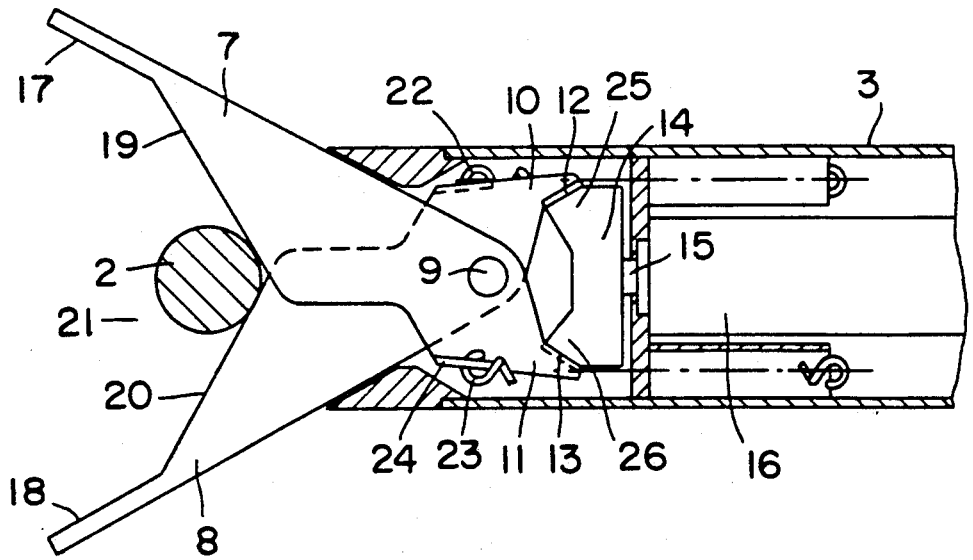
FIG. 2 is an enlarged top view of the front part of the catcher device with the clamping elements open and a fiber sliver which has been laid in it.

In FIG. 2, the catcher device 3 is represented in a partial sectional view, whereby the rear end of the catcher device 3, with the connection to the manipulator, is cut away. Two clamping elements 7, 8 are arranged on the front end of the catcher device 3, and are supported on a common bearing 9 and form the clamp 6. The clamping elements 7, 8 pivot on the bearing 9 and perform closing and opening movements, similar to that of tongs. Each of the clamping elements 7, 8 has a clamping surface 17 or 18 on its front end, at which inclined sliding surfaces 19 or 20 are adjoined. In the opened state, the clamping elements 7, 8 of the clamp 6, the clamping surfaces 17, 18 and the inclined sliding surfaces 19, 20 form an inlet funnel 21 for the fiber sliver 2 and are directed in a direction opposite to the direction of rotation of the can 1. On these rear ends, the clamping elements 7, 8 are provided with operating levers 10, 11, which have working surfaces 12, 13. Between the operating levers 10, 11, a cam plate 14 is supported and fastened to the motor shaft 15. This cam plate 14 has two trigger cams 25, 26 with sliding surfaces 32, 33, whereby the working surfaces 12, 13 of the operating levers 10, 11 lie on these sliding surfaces. The shaft 15 is rotated by a driving motor 16, which is connected with a control (not shown) and is equipped with a source of energy in the conventional manner.

Each of the clamping elements 7, 8 has a groove 24, in which a tensioning element 22, 23 is attached in the form of a tension spring. Tension springs 22, 23 hold the operating levers 10, 11 against the cam plate 14 and have the effect that the working surfaces 12, 13 follow the control surfaces of the cam plate 14. Instead of the tension springs, other means, such a pneumatic or hydraulic cylinders can be built in as tension elements 22, 23. According to the representation in FIG. 2, the clamping elements 7, 8 are situated in the widest opening position. The end of the fiber sliver 2 is laid in the inlet funnel 21, so that it is fixed and clamped between the clamping surfaces 17, 18 after the clamping elements 7, 8 have closed.

Figure 3:
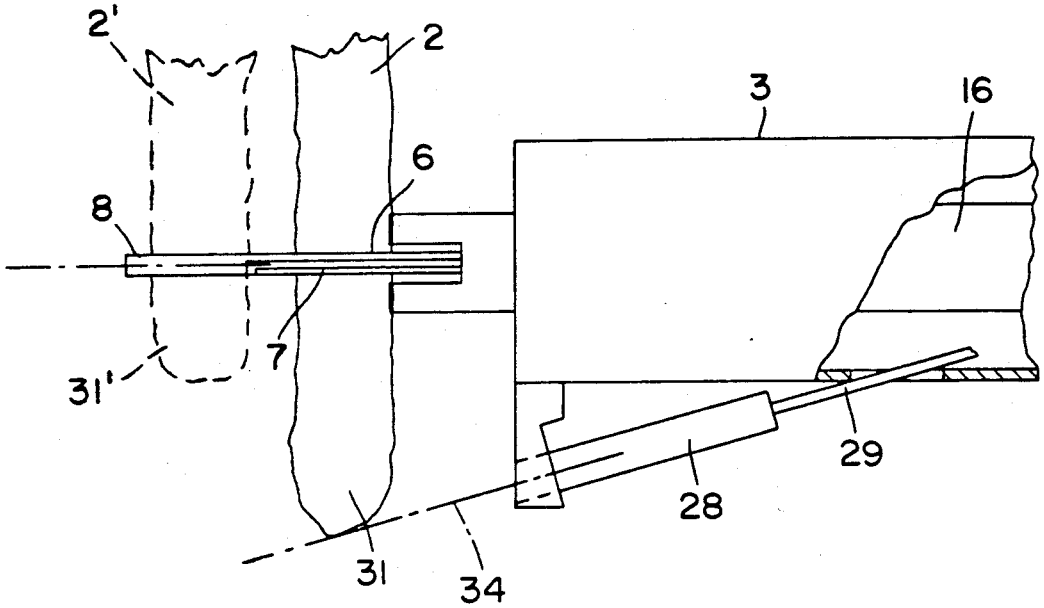
FIG. 3 is a side view of the catcher device according to FIG. 2.

The side view represented in FIG. 3 of the front part of the catcher device 3 according to FIG. 2, shows the catching operation at the end 31 of the fiber sliver 2. The catcher device 3 is equipped with a sensor 28, such as a known proximity sensor. The sensor 28 is connected over a control lead 29 with the driving motor 16, or its control. The measuring range of the sensor extends in the direction of the axis 34 and the sensor 28 reacts immediately when a fiber sliver 2 is laid in the inlet funnel 21 between the opened clamping elements 7, 8 of the clamp 6. With a fiber sliver 2, which has been laid in, the sensor 28 produces a control signal, which puts the driving motor or the clamp 6 into the state of readiness to close. If the fiber sliver 2 is drawn upwards through the opened clamp 6, then the end 31 of the fiber sliver 2 reaches the axis 34 of the measuring range of the sensor 28 after a certain period of time. As soon as the end 31 of the fiber sliver 2 has passed the axis 34, the sensor 28 produces a second control signal which activates the driving motor 16, whereby the motor shaft 15, and with it the cam plate 14 are rotated and the trigger cams are actuated. Through this motion, the clamping elements 7, 8 of the clamp 6 are closed and the fiber sliver is fixed in position, as shown in broken lines in FIG. 3 and characterized with the reference symbol 2' and 31'. This position of the end 31' of the fiber sliver 2' corresponds to the desired delivery position from which the fiber sliver 2 can be delivered to the receiving device of a textile machine.

Figure 4:
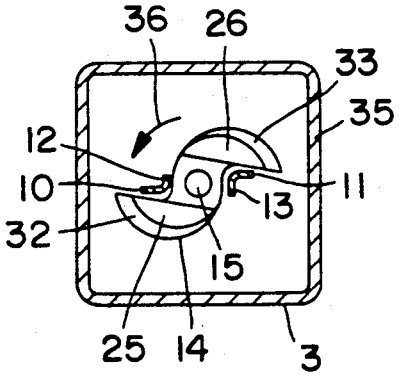
FIG. 4 is a cross sectional view taken through the catcher device, according to FIG. 2, in the area of the cam plate in a simplified representation.

In FIG. 4, the cam plate 14 is shown in detail, whereby the catcher device 3 in the area of the cam plate 14 is sectioned and represented in the view from the front of cam plate 14. The cam plate 14 is encased by a housing 35 of the catcher device 3 and can be rotated in the direction of the arrow 36 with the motor shaft 15. The cam plate 14 has two trigger cams 25 and 26 each of which axis provided with a sliding surface 32, 33. The operating levers 10, 11 of the clamping elements 7, 8 are arranged on both sides of the cam plate 14. The working surfaces 12, 13 are fixed to operating levers 10, 11, respectively. In FIG. 4, the clamping elements 7, 8 of the clamp 6 are closed, that means the working surfaces 12, 13 of the operating levers 10, 11 do not come into contact on the cam plate 14. If the cam plate 14 is rotated in the direction of the arrow 36, then the working surfaces 12, 13 run on the contours of the two trigger cams 32, 33 and are pivoted outward by means of the sliding surfaces 32, 33. Through this motion, the clamping elements 7, 8 open until they reach the maximum opening position, as represented in FIG. 2. This maximum position is reached when the cam plate is rotated through nearly 180°. In this position, the drive motor 16 is stopped and the catcher device 3 is ready to receive a fiber sliver.

Figure 5:
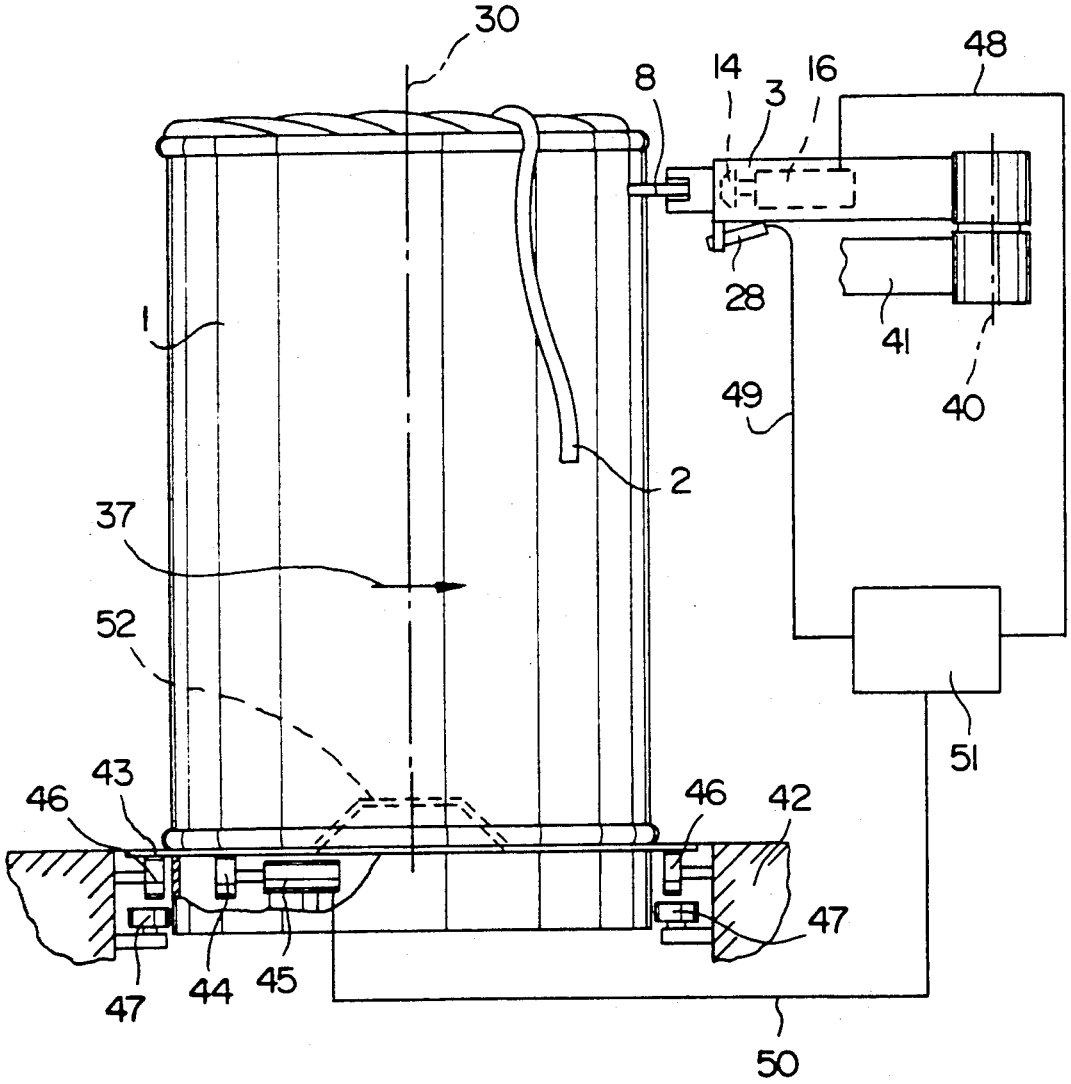
FIG. 5 is a front elevation of the invention illustrated in FIG. 1.

Referring now to FIG. 5, the can 1 is standing on a revolving plate 43 centered horizontally with a truncated cone 52 associated with the revolving plate 43 engaging with a corresponding recess on the bottom of the sliver can.

The revolving plate 43 is built into a transport vehicle having bearing rollers 46 and 47. The drive to the revolving plate is effected by a friction wheel 44 which engages the underside of the revolving plate 43 and is driven by a motor 45 attached to the frame 42 of the transport vehicle. With regard to this arrangement we refer to our prior Swiss patent application No. CH-4014/89-2 of Nov. 7, 1989. The catcher device 3 is pivotally mounted by means of the axis 40 on a pivot arm 41 and is illustrated in the position corresponding to FIG. 1 in engagement with the outer surface 4 of the can 1.

The swivel arm 41 is attached (not shown) to a vertical support and is moved vertically in addition to the horizontal pivotal movement to bring the sliver into position relative to a sliver receiver (not shown).

A central control device 51 is connected with motor 45 by a control lead 50, with motor 46 by a control lead 48, and with the sensor by a control lead 49. The control device 51 operates so that the motor 45 stops when the clamping elements 7, 8 are in a closed position.

As can be seen from the FIGS. 1 to 5, the fixing of the fiber sliver 2 is effected in such a way, that after the filling of the can 1, the fiber sliver 2 is cut and the end 31 is hung down in some place or other over the rim of the can. Thereby, the end 31 of the fiber sliver 2 is normally situated at least one hundred millimeters below the rim of the can. The catcher device 3 is now brought into the space round the outer surface 4 of the can 1 and that is, on a level which is somewhat below the can rim. Thereby, the clamp 6 opens and the clamping element 7 lies, with a little clearance, practically on the outer surface 4 of the can 1. The can 1 is now rotated long enough until the fiber sliver 2, which hangs down over the can rim on the outer surface 4, is laid in the open clamp 6 of the catcher device 3.

As soon as the fiber sliver 2 arrives in this area, the sensor 28 reacts and puts the catcher device into the state of readiness to close. The can 1 is now rotated further whereby the fiber sliver 2 is drawn through the clamp 6. In this member, the end 31 of the clamping device 3 has reached a predetermined spacing. When the end 31 of the axis 34 runs through the measuring range axis of the sensor 28, the sensor 28 produces the control command to close the clamp 6, which results through rotating the cam plate 14. The state of readiness to close is effected rapidly as the operating levers 10, 11 are situated in the opening position of the clamp 6 at the outermost point of the sliding surfaces 32, 33. As soon as the cam plate 14 is rotated further in one direction of the arrow 36, the operating levers 10, 11 follow over the trigger cams 25, 26 and the clamping elements 7, 8 are immediately closed by the tension springs 22, 23. As the whole operation progresses relatively quickly, the end 31 of the fiber sliver 2 still moves until it is in the position 31' where it is finally fixed and retained. With the aid of the manipulator, now shown, the end 31 of the fiber sliver 2 can now be brought into a predetermined, desired position in the relationship to the can 1 or to the textile machine which should take over the can 1. The entire operation progresses automatically and does not require any manual intervention.

In the example represented, the catcher device 3 can be moved, in addition, along the circular path 5, whereby it moves concentrically to the outer jacket 4 of the can 1. A more rapid catching of the fiber sliver 2 is possible, when the can 1 is moved in the direction of the arrow 37 and the catcher device 3 is moved in the same direction as the arrow 38. The fixing operation of the sliver end 31 can be delayed, if the catcher device 3 is moved in the same direction as the arrow 37.

It is clear from this explanation that the advantages of the automatic fixing of the end 31 of the fiber sliver 2 with the aid of the method and device according to the invention are also possible when the cam 1 is stationary and only the catcher device 3 is moved along the curved path 5. The method, according to the invention, and the catcher device are consequently adapted simply to the requirements of the different can changing devices and enable savings to be made in the operating time for fixing the end 31 of the sliver 2 and the positioning of this sliver end 31 as well as a substantial reduction of the susceptibility to disturbances.

What is claimed is:

1. An apparatus for locating and clamping an end of a fiber sliver along an outer surface of a sliver can, said sliver can having a longitudinal axis, comprising:

(a) clamping means having two opposed clamping elements, one of which is disposed adjacent to said outer surface of said sliver can wherein said clamping elements are spaced apart in an opened position, and rotating cam means for closing said clamping means;

(b) means for supporting said sliver can;

(c) means for moving said clamping means and said sliver can support means relative to each other in such a way that said outer surface of said sliver cam moves past said clamping elements;

(d) sensing means for detecting a fiber sliver disposed between said opposed clamping elements and for generating a signal indicative of the position of said fiber sliver between said opposed clamping elements;

(e) drive means for rotating said cam means to move said clamping elements into a closed position; and (f) control means for activating said drive means for rotating said cam means to close said clamping elements when said fiber sliver reaches a predetermined length, to clamp and fix said fiber sliver in a predetermined position and to stop the relative movement between said clamping means and said sliver can wherein said clamping elements move to clamp said sliver.

2. Apparatus as set forth in claim 1, wherein said can support means is driven so as to rotate said sliver cam about said longitudinal axis.

3. Apparatus as set forth in claim 2, wherein said clamping means opens in a direction opposite the direction said can support means rotates said can.

4. Apparatus as set forth in claim 1, wherein said clamping means includes means for moving said clamping means in an arc about said sliver can.

5. Apparatus as set forth in claim 1, wherein said can support rotates said sliver can in a first direction about said longitudinal axis and said drive means moves said clamping means in an arc about said longitudinal axis of said sliver can in a second direction which is opposite to said first direction.

6. Apparatus as set forth in claim 1, wherein said drive means drives said can support means in a first direction and moves said clamping means in the same direction in an arc about the longitudinal axis of said sliver can at a different speed from that imparted to said can support.

7. Apparatus as set forth in claim 1, wherein said means to move said clamping means includes means to move said clamping means to a textile machine after said sliver is clamped in said clamping means.

8. Apparatus as set forth in claim 1, wherein said control means includes means for positioning said clamping means for closing as soon as a fiber sliver is detected by said sensing means.

9. Apparatus as set forth in claim 1, wherein said clamping elements are pivoted about a common pivot and comprises opposed clamping surfaces on one end and operating levers on the opposite ends of said clamping elements.

10. Apparatus as set forth in claim 1, wherein said clamping means pens in a direction of relative movement between said clamping means and said sliver can.

11. Apparatus as set forth in claim 1, wherein each of said clamping elements comprises a clamping surface on opposed ends and inclined sliding surfaces to form an inlet funnel when said clamping elements are open.

12. Apparatus as set forth in claim 1, wherein said clamping elements are urged into a closing position by tension means.

13. An apparatus for locating and clamping an end of a fiber sliver along an outer surface of a sliver can, said sliver can having a longitudinal axis, comprising:

(a) clamping means having two opposed clamping elements, one of said elements being disposed adjacent to said outer surface of said sliver can when said clamping elements are in an open position, tension means to urge said clamping elements into a closed position, and cam means for maintaining said clamping elements in an opened position;

(b) means for supporting said sliver can;

(c) means for moving said clamping means and said sliver can support means relative to each other in such a way that said outer surface of said sliver can moves past said one of said clamping elements disposed adjacent to the outer surface of said sliver cans;

(d) sensing means for detecting a fiber sliver disposed between said clamping elements and for generating a signal indicative of the position of said fiber sliver between said clamping elements;

(e) drive means for moving said cam means to permit said tension means to move said clamping elements into a closed position; and (f) control means for activating said drive means for moving said cams to move said opposed clamping elements into a closed position when said fiber sliver reaches a predetermined length, to clamp and fix said fiber sliver in a predetermined position, and to stop the relative movement between said clamping means and said sliver can when said clamping means closes to clamp said sliver.

14. An apparatus for locating and clamping an end of a fiber sliver along an outer surface of a sliver can, said can having a longitudinal axis, comprising:

(a) clamping means having two clamping elements disposed with said elements open in a first direction and one of said elements in contact with said outer surface of said sliver can when said clamping means is open;

(b) means for supporting said sliver can;

(c) means for moving said clamping means and said sliver can support means relative to each other in such a way that said outer surface of said sliver can moves past said clamping elements in a direction opposite to said first direction;

(d) sensing means for detecting a fiber sliver in said open clamping means and for generating a signal which is indicative of the position of said fiber sliver;

(e) drive means for closing said clamping means; and (f) control means to close said clamping means when said fiber sliver reaches a predetermined length, to clamp and fix said fiber sliver in a predetermined position and to stop said relative movement between said clamping means and said sliver can when said clamping means closes to clamp said fiber sliver.

15. An apparatus for locating and clamping an end of a fiber sliver along an outer surface of a sliver can, said sliver can having a longitudinal axis, comprising:

(a) clamping means having a plurality of clamping elements disposed with one of said clamping elements in proximity to said outer surface of said fiber can when said clamping means is open;

(b) means for supporting said sliver can;

(c) means for moving said clamping means and said sliver can support means relative to each other in such a way that said outer surface of said sliver can moves past said clamping means, in proximity without of said clamping elements;

(d) sensing means for detecting a fiber sliver in said open clamping means and for generating a signal indicative of the position of said fiber sliver in said open clamping means, said sensing means being disposed with a clearance of a clamping plane which extends above a longitudinal axis of said clamping means;

(e) drive means for closing said clamping means; and (f) control means connected to said sensing means and said drive means for activating said drive means to close said clamping means when said fiber sliver reaches a predetermined length, to clamp and fix said fiber sliver in a predetermined position and to stop said relative movement between said clamping means and said sliver can when said clamping means closes to clamp said sliver.

16. A method for locating and clamping an end of a fiber sliver along an outer surface of a sliver can, comprising the following steps:

(a) supporting said sliver can for rotation about its longitudinal axis;

(b) supporting a clamping means having two open opposed clamping elements, with one of said clamping elements disposed adjacent to said outer surface of said sliver can and said clamping means having cam means for closing said clamping means;

(c) rotating said sliver can past said open clamping elements to bring an end of said fiber sliver into said open clamping elements;

(d) sensing when said end of said sliver reaches a predetermined position between said clamping elements;

(e) moving said cam means to move said clamping elements into clamping contact with said sliver when said end of said sliver reaches said predetermined position; and (f) stopping the rotation of said sliver can when said clamping means close on said sliver end.

17. A method as set forth in claim 16, including the additional step of moving said clamping means in an arc about the longitudinal axis of said sliver can.

18. A method as set forth in claim 17, including the step of moving said clamping means in a direction opposite to the direction that said sliver can rotates.

19. A method as set forth in claim 18, including the steps of moving said clamping means at the same rate of speed as said sliver can rotation.

20. A method as set forth in claim 17, including the step of moving said clamping means in the same direction as said sliver can rotation but at a different rate of speed.

21. A method as set forth in claim 16, including the steps of moving said sliver to a textile machine after said sliver is clamped by said clamping means.

* * * * *